US009452305B2

(12) United States Patent
De Vries et al.

(10) Patent No.: US 9,452,305 B2
(45) Date of Patent: Sep. 27, 2016

(54) RADIATION-ACTIVATED SPRINKLER AND RELATED METHODS

(71) Applicant: Factory Mutual Insurance Company, Johnston, RI (US)

(72) Inventors: Jaap De Vries, South Easton, MA (US); Christopher J. Wieczorek, Foxboro, MA (US); Benjamin D. Ditch, Shrewsbury, MA (US); Stephen P. D'Aniello, Franklin, MA (US); John A. LeBlanc, Milford, MA (US)

(73) Assignee: Factory Mutual Insurance Company, Johnston, RI (US)

( * ) Notice: Subject to any disclaimer, the term of this patent is extended or adjusted under 35 U.S.C. 154(b) by 57 days.

(21) Appl. No.: 14/450,859

(22) Filed: Aug. 4, 2014

(65) Prior Publication Data

US 2016/0030787 A1 Feb. 4, 2016

(51) Int. Cl.
*A62C 37/12* (2006.01)
*B05B 1/26* (2006.01)

(52) U.S. Cl.
CPC ..... *A62C 37/12* (2013.01); *B05B 1/265* (2013.01)

(58) Field of Classification Search
CPC ..... A62C 37/08; A62C 37/10; A62C 37/11; A62C 37/12
See application file for complete search history.

(56) References Cited

U.S. PATENT DOCUMENTS 1,030,299 A 6/1912 Hammond
3,039,536 A 6/1962 Moore et al.
3,107,732 A 10/1963 Bakos
3,633,676 A * 1/1972 Gloeckler ..... A62C 37/09 169/40
3,727,695 A * 4/1973 Danton ..... A62C 37/08 169/37
3,783,947 A * 1/1974 Dix ..... A62C 37/12 169/40
3,872,928 A 3/1975 Livingston
4,066,129 A * 1/1978 Anderson ..... A62C 37/10 169/37
4,105,076 A 8/1978 Simons et al.
4,281,718 A 8/1981 Claussen et al.
5,613,563 A * 3/1997 Johnson ..... A62C 37/12 169/39
6,296,062 B1 10/2001 Sundholm
6,851,482 B2 2/2005 Dolan (Continued)

FOREIGN PATENT DOCUMENTS

CA 2 617 237 A1 11/2001
DE 10 2008 021 493 A1 11/2009

OTHER PUBLICATIONS

International Search Report issued Nov. 9, 2015 in International Patent Application No. PCT/US2015/042931.

(Continued)

*Primary Examiner* — Ryan Reis
(74) *Attorney, Agent, or Firm* — Venable LLP; Steven J. Schwarz

(57) ABSTRACT

A radiation-activated sprinkler includes a sprinkler body defining a main orifice, the main orifice adapted to couple to a source of pressurized liquid; a deflector coupled to the body; a valve adapted to seat on the main orifice to block the source of pressurized liquid; a linkage mechanism adapted to retain the valve on the main orifice; and one or more fusible links coupled to the linkage mechanism, wherein the one or more fusible links are located substantially externally with respect to the sprinkler body, deflector, and linkage mechanism. The one or more fusible links are adapted to release when exposed to an amount of radiation that exceeds a predetermined threshold, thereby releasing the linkage mechanism from the valve. Other features and related methods are also described.

24 Claims, 17 Drawing Sheets

(56) References Cited

U.S. PATENT DOCUMENTS

| | | | |
|---|---|---|---|
| 7,017,673 | B2 | 3/2006 | Gargani |
| 7,066,273 | B2 | 6/2006 | Tan |
| 7,712,542 | B2 | 5/2010 | Munroe |
| 7,819,201 | B2 | 10/2010 | Pounder et al. |
| 7,845,425 | B2 | 12/2010 | Flynn |
| 8,122,968 | B2 | 2/2012 | Johnson |
| 8,226,017 | B2 | 7/2012 | Cohen |
| 8,281,471 | B2 | 10/2012 | Florian |
| 2008/0000649 | A1 | 1/2008 | Guirguis et al. |
| 2009/0178815 | A1 | 7/2009 | Anderson et al. |
| 2010/0326677 | A1 | 12/2010 | Jepsen et al. |
| 2011/0214888 | A1 | 9/2011 | Alchalel et al. |
| 2013/0025888 | A1 | 1/2013 | Eckholm et al. |

OTHER PUBLICATIONS

Written Opinion issued Nov. 9, 2015 in International Patent Application No. PCT/US2015/042931.

* cited by examiner

RADIATION-ACTIVATED SPRINKLER AND RELATED METHODS

TECHNICAL FIELD

This patent application relates generally to the field of fire protection. More specifically, this patent application relates to radiation-activated fire protection sprinklers, systems, and related methods.

BACKGROUND

Conventional fire protection sprinklers operate primarily due to convective flow of hot gasses past the sprinkler's fusible element. This can render conventional sprinklers ineffective in situations where hot gasses do not reach the fusible element. For example, conventional sprinklers may be ineffective in areas where hot ceiling layers are absent, such as, in installations under grated mezzanines. Similarly, conventional sprinklers may also be ineffective for protecting external, covered storage, and specific hazards such as lubrication oil systems and combustible walls.

SUMMARY

Embodiments of the present invention provide a fire protection sprinkler that operates due to exposure to thermal radiation. Embodiments of the fire protection sprinkler can provide fire protection options where previously none existed, for example, in applications where no convective ceiling layer is formed.

According to an embodiment, a radiation-activated sprinkler comprises: a sprinkler body defining a main orifice, the main orifice adapted to couple to a source of pressurized liquid; a deflector coupled to the body; a valve adapted to seat on the main orifice to block the source of pressurized liquid; a linkage mechanism adapted to retain the valve on the main orifice; and one or more fusible links coupled to the linkage mechanism, wherein the one or more fusible links are located substantially externally with respect to the sprinkler body, deflector, and linkage mechanism; wherein the one or more fusible links are adapted to release when exposed to an amount of radiation that exceeds a predetermined threshold, thereby releasing the linkage mechanism from the valve.

According to an embodiment, a method of activating a sprinkler comprises: providing a sprinkler including a main orifice coupled to a supply of fluid, a valve seated on the main orifice, and one or more fusible links coupled to the valve; and subjecting the sprinkler to radiation, wherein exposure to external radiation that exceeds a predetermined threshold causes one or more of the fusible links to melt, whereby the valve displaces from the main orifice and the fluid expels from the main orifice.

BRIEF DESCRIPTION OF THE DRAWINGS

The foregoing and other features and advantages will be apparent from the following, more particular, description of various exemplary embodiments, as illustrated in the accompanying drawings, wherein like reference numbers generally indicate identical, functionally similar, and/or structurally similar elements.

DETAILED DESCRIPTION

Various embodiments of the invention are discussed in detail below. While specific embodiments are discussed, it should be understood that this is done for illustration purposes only. A person skilled in the relevant art will recognize that other components and configurations can be used without departing from the spirit and scope of the invention.

As used herein, terms such as "front," "back," "left," "right," "upper," "lower," "top," and "bottom" are used to describe positions relative to one another only and not to denote an absolute position. For example, an "upper portion" can become a "left," "right," or "lower" portion by rotating the item, although it can still be referred to as an "upper" portion of the item.

Embodiments of the present invention provide fire protection sprinklers, systems, and methods that can activate in response to exposure to radiation alone, however, embodiments may activate when exposed to radiation in combination with other heat transfer mechanisms, such as conduction and convection. An objective is to provide sprinkler systems that activate when radiation is the only, or primary, heat source, in order to protect areas where exposure to other heat sources, such as conduction and convection, is limited, thereby rendering conventional sprinklers inoperable. Embodiments of the present invention may retain their capability to operate due to convection or conduction alone.

Embodiments of a radiation-activated sprinkler can be beneficial in cases where sprinkler protection is needed away from the ceiling or other surface, e.g., to protect unique arrangements of combustible materials or building interior features. Embodiments of a radiation-activated sprinkler can essentially be located in the free space above a protected hazard.

Embodiments of a radiation-activated sprinkler can provide improved view factors for the fusible link(s). As described in more detail below, embodiments may have the fusible link(s) placed exterior to all, or substantially all, of the sprinkler components, thereby preventing other sprinkler components from obstructing the view factor of the fusible link(s), independent of the angle of incidence. According to embodiments, the fusible link(s) may face downward toward the potential fire source, e.g., to minimize the impact of droplets from adjacent sprinklers and/or to improve the view factor of the fusible link(s).

Figure 5:
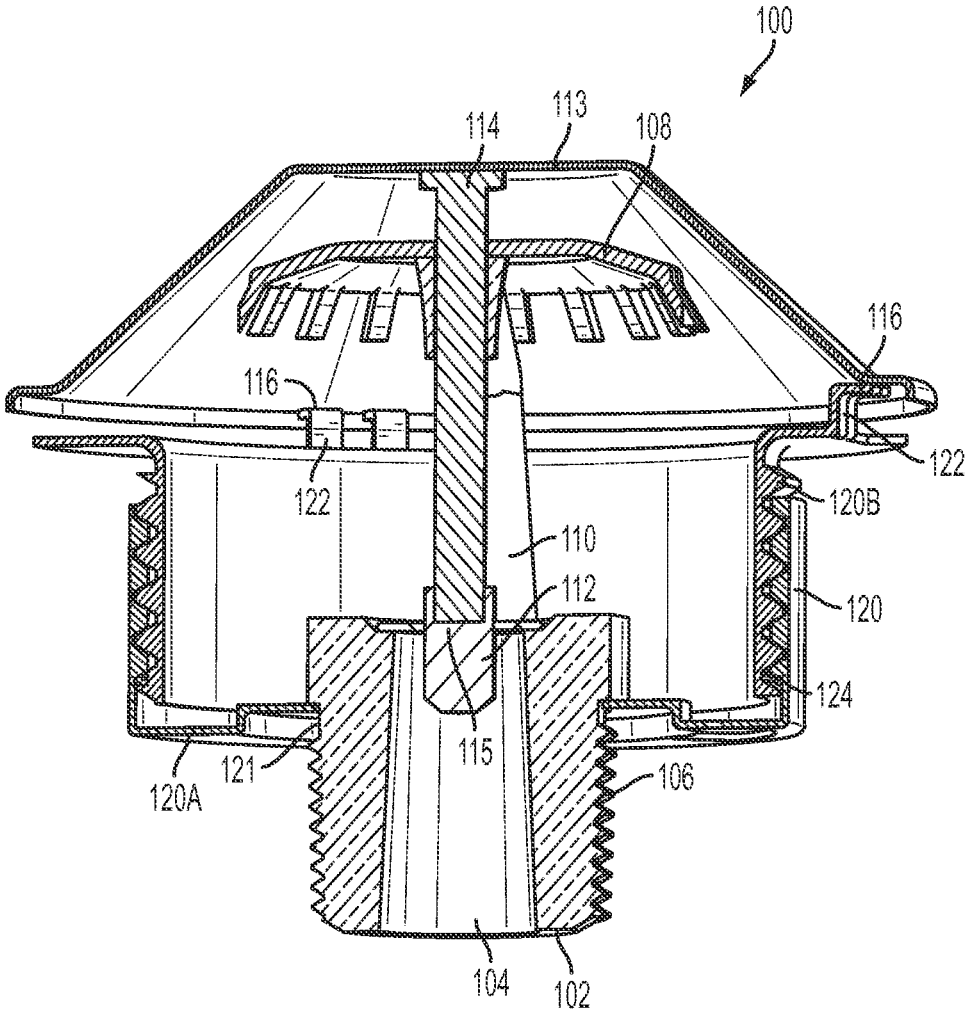
FIG. 5 is a side, cross-sectional view of the sprinkler of FIG. 1.
Figure 6:
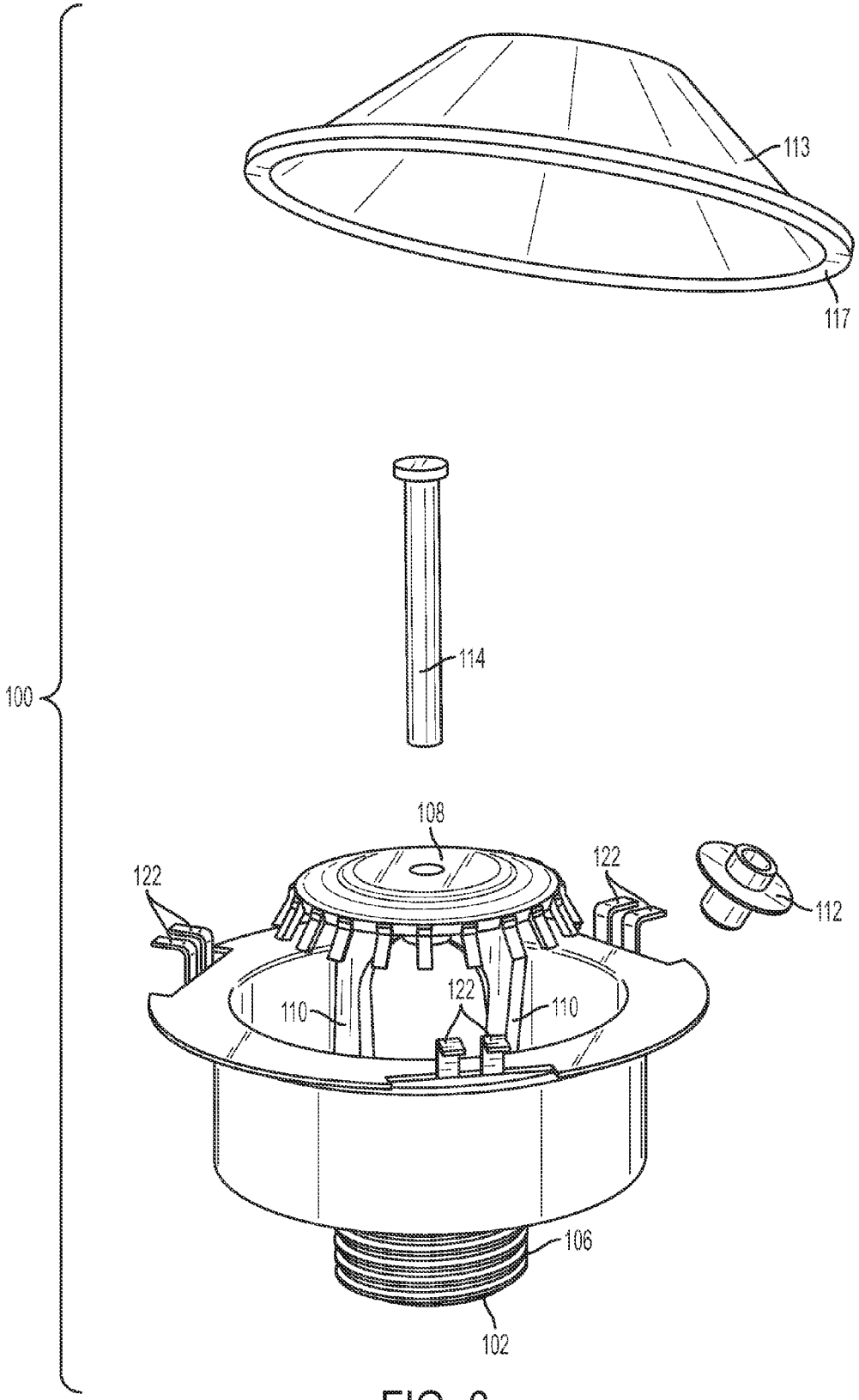
FIG. 6 is a partially-exploded, perspective view showing the sprinkler of FIG. 1 after activation.

FIGS. 1-6 depict an embodiment of a radiation-activated sprinkler 100 having one or more fusible links distributed substantially circumferentially around the sprinkler body, deflector, and linkage mechanism. FIGS. 1-5 depict the sprinkler 100 prior to activation, and FIG. 6 shows the sprinkler 100 after activation.

The sprinkler 100 can include a sprinkler body 102 defining a main orifice 104. The main orifice 104 can be coupled to a source of pressurized liquid, such as the internal network of pipes within a building or other structure. The pressurized liquid can comprise plain water, water mixed with other substances, or other liquids known in the art. According to the embodiment shown, the sprinkler body 102 can include pipe threads 106 that secure the sprinkler 100 to the pipes or other components of a fire protection system, however, other structures can be used instead of pipe threads 106.

Referring to FIGS. 5 and 6, the sprinkler 100 can include a deflector 108 that is coupled to the body 102, for example, by a pair of arms 110. During activation, liquid dispensed from the main orifice 104 can impinge upon the deflector 108, and the deflector can redirect the liquid into a spray pattern suitable for suppressing fires or other hazards, as will be known to one of ordinary skill in the art based on this disclosure. As shown in the cross-sectional view of FIG. 5, the sprinkler 100 can include a valve 112 that seats on the main orifice 104 to block the source of pressurized liquid. The sprinkler 100 can also include a shield 113, such as a dome-shaped shield, that extends over all or a portion of the sprinkler 100. The shield 113 can be coupled to the sprinkler body 102 through one or more fusible links 116, for example, distributed about the outer periphery 117 of the shield 113. The fusible links 116 can be adapted to release, e.g., melt, when exposed to an amount of radiation that exceeds a predetermined threshold, thereby releasing the shield 113 from the sprinkler body 102 and causing the sprinkler to activate, as shown in FIG. 6.

Still referring to FIGS. 5 and 6, the sprinkler 100 can include a linkage mechanism, such as strut 114 that engages the valve 112 on one end and the shield 113 on the other end. Accordingly, when in place, the shield 113, also referred to herein as the escutcheon, can retain the valve 112 on the main orifice 104 via the strut 114. However, when the shield 113 is released from the sprinkler body 102, as shown in FIG. 6, the strut 114 can disengage from the valve 112 thereby allowing liquid to release from the main orifice 104. With reference to FIG. 5, the strut 114 can extend through an opening in the deflector 108, however, other embodiments are possible. As also shown in FIG. 5, the strut 114 can rest within a recess 115 in the valve 112; however, other embodiments are possible.

As shown in FIG. 5, the fusible links 116 can be located externally with respect to the sprinkler body 102, deflector 108, supporting arms 110, strut 114, and other structures of the sprinkler 100. The external location of the fusible links 116 can improve the view factor of the sprinkler 100 by preventing the sprinkler body 102, deflector 108, supporting arms 110, strut 114, or other sprinkler structures from obstructing the fusible links 116 from a source of radiation. Furthermore, the escutcheon 113 can help collect radiation and transfer it to the soldered links via conduction. In the embodiment of FIGS. 1-6, the fusible links 116 are distributed substantially circumferentially around the sprinkler 100, however, other external locations are possible, as will be described in more detail below.

Figure 1:
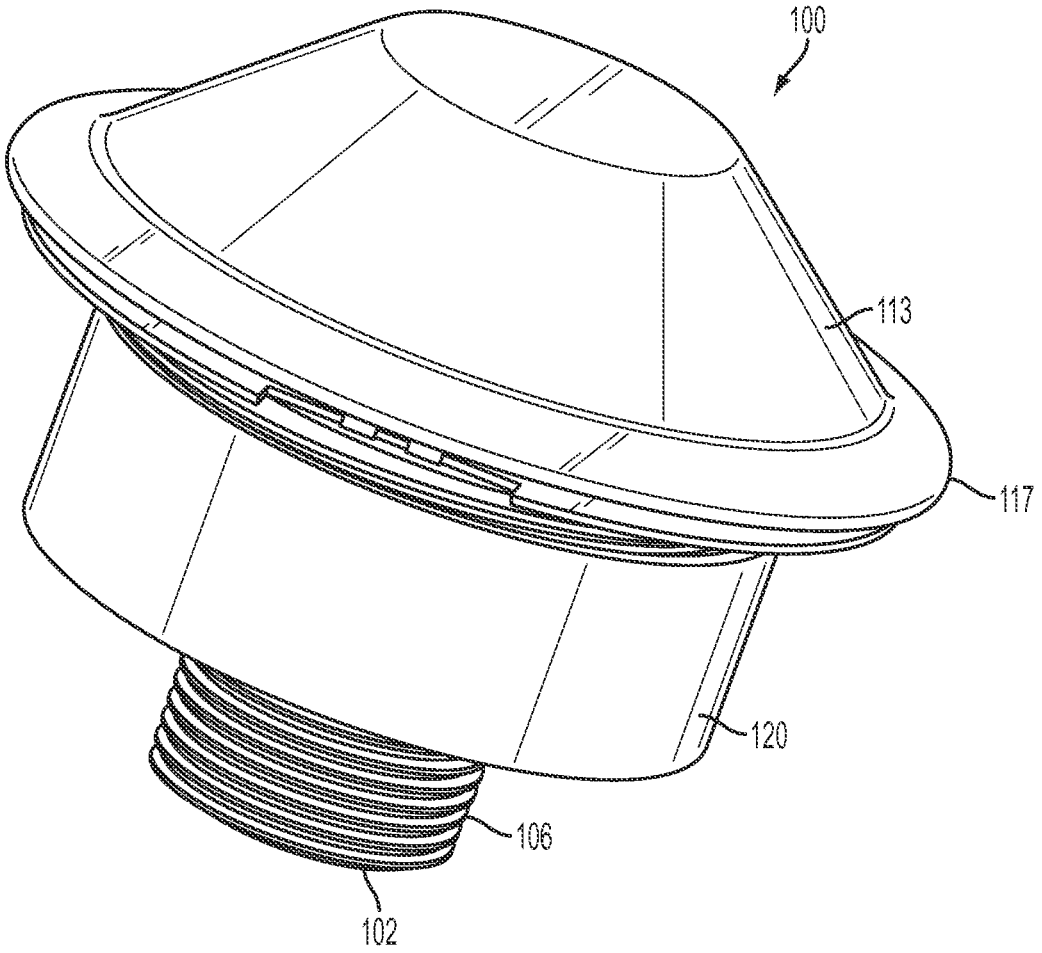
FIG. 1 is a perspective view of a radiation-activated sprinkler according to a first embodiment.
Figure 2:
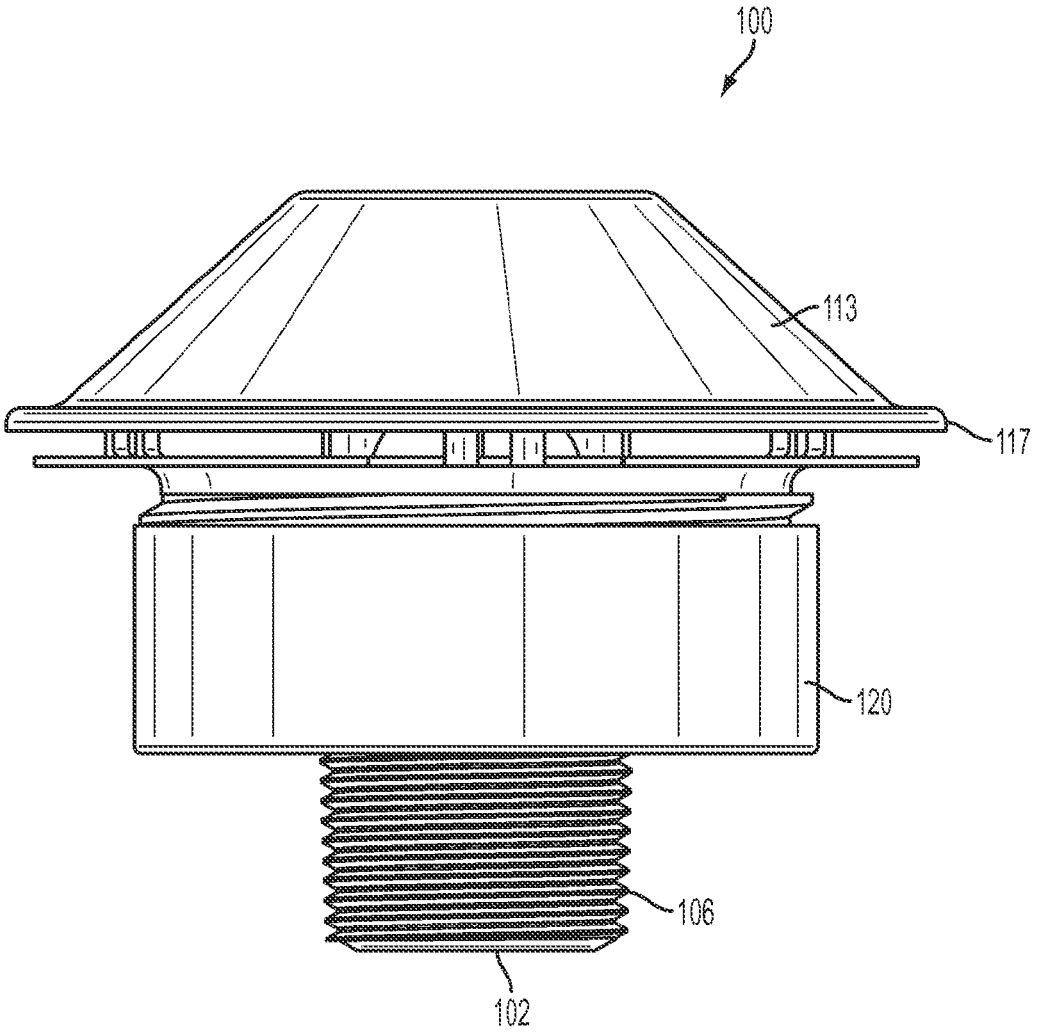
FIG. 2 is side view of the sprinkler of FIG. 1
Figure 3:
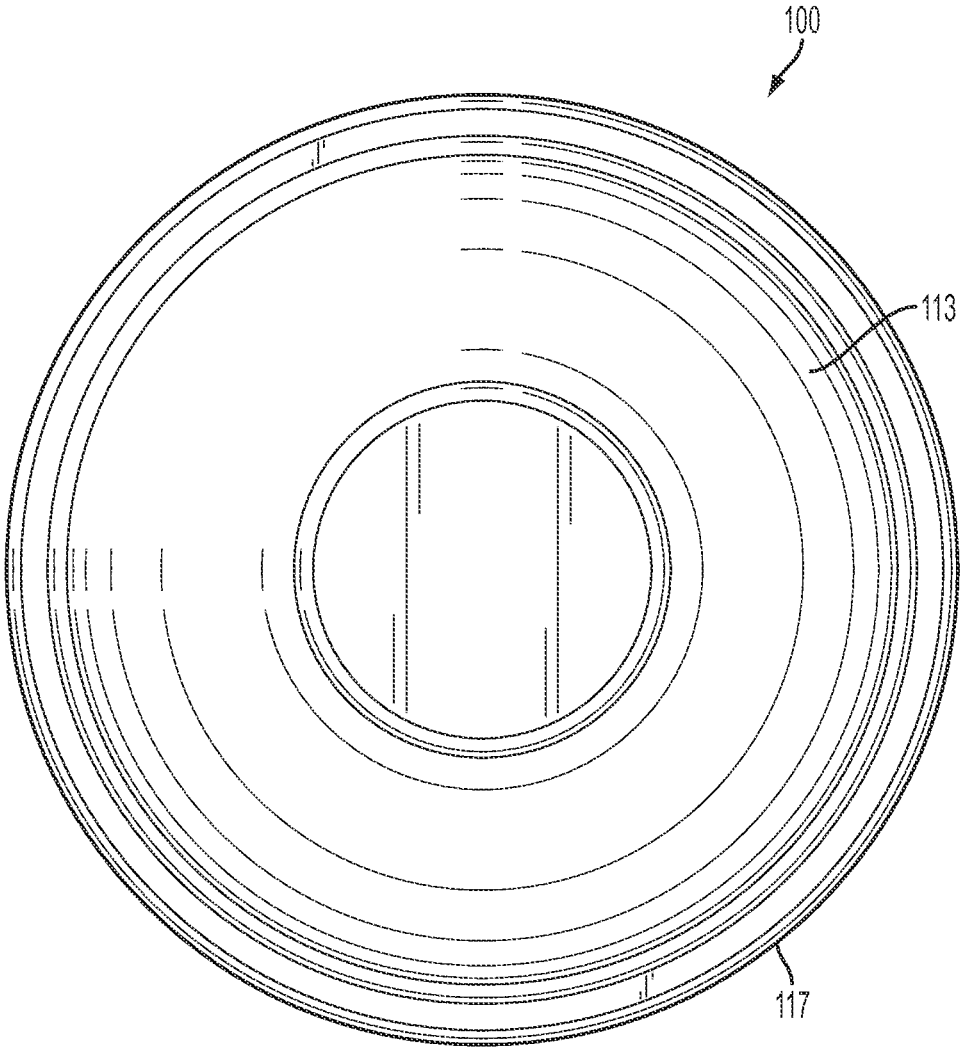
FIG. 3 is a top view of the sprinkler of FIG. 1
Figure 4:
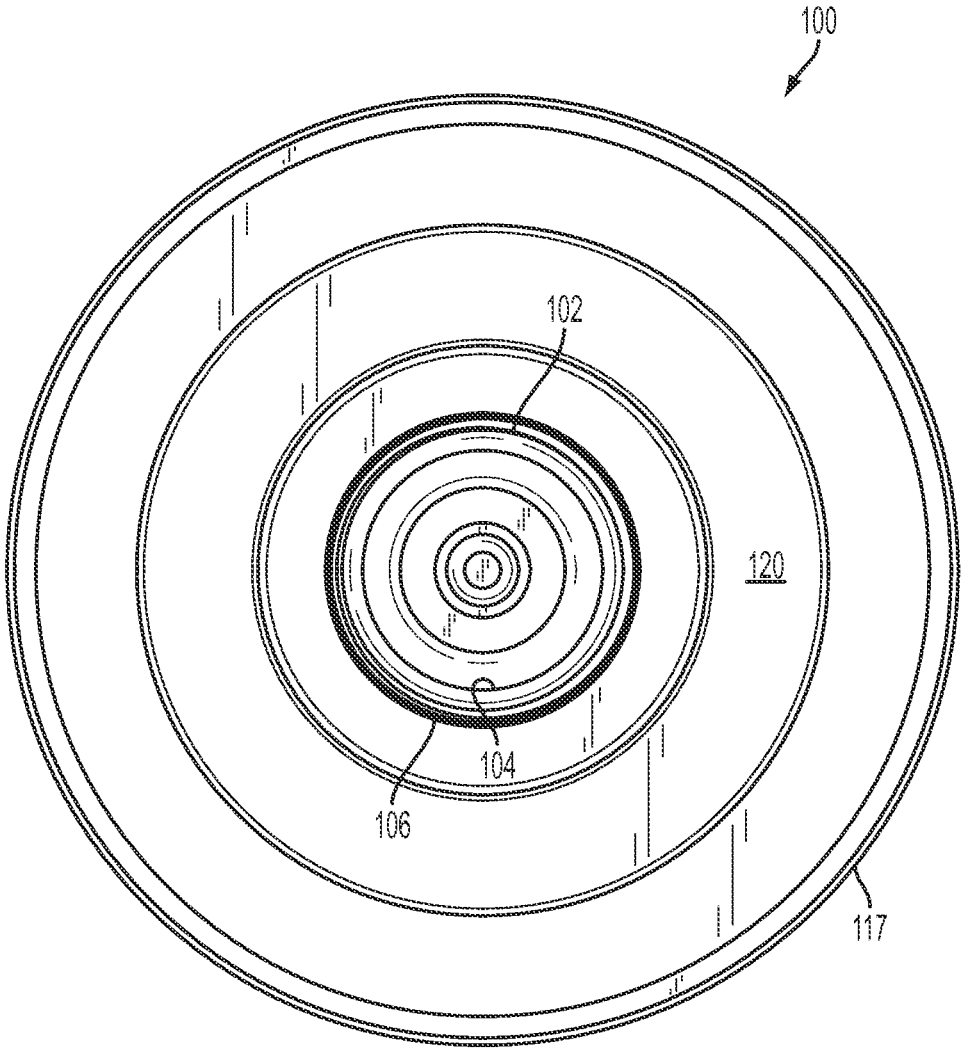
FIG. 4 is a bottom view of the sprinkler of FIG. 1.

Referring to FIGS. 2 and 5, the sprinkler 100 can include a lower housing 120 coupled to the sprinkler body 102, e.g., seated within an undercut 121 in sprinkler body 102, as shown in FIG. 5. The lower housing 120 can include a first portion 120A that is connected to the sprinkler body 102, and a second portion 120B that is connected to the first portion 120A, for example, by mating threads 124. The threads in portions 120A and 120B can allow tension to be applied on the valve assembly 112.

As discussed above, the shield 113 can be secured to the sprinkler body 102 through one or more fusible links 116. Referring to FIG. 5, the fusible links 116 can be located between the lower housing 120 and the shield 113. More specifically, the lower housing 120 can include multiple soldered points 122 (e.g., having a flange-like shape) that provide point contact with the shield 113. The fusible links 116 can comprise solder joints located between the solder points 122 and the shield 113, however, other embodiments with and without solder points 122 are possible. According to embodiments having solder points, the solder points can be associated with the sprinkler body 102, the shield 113, or both. According to embodiments, the older points 122 and/or shield 113 can be made from alloy, such as nickel alloy; however, other materials are possible.

Referring to FIG. 6, the sprinkler 100 can activate when exposed to a sufficient amount of radiation to melt the fusible links 116. When this occurs, the shield 113 can separate from the body 102, freeing the strut 114 to disengage from the valve 112. As a result, the force of liquid pressing on the valve 112 displaces the valve 112 from the main orifice 104, thereby activating the sprinkler 100, and causing liquid to dispel from the main orifice 104.

Figure 11:
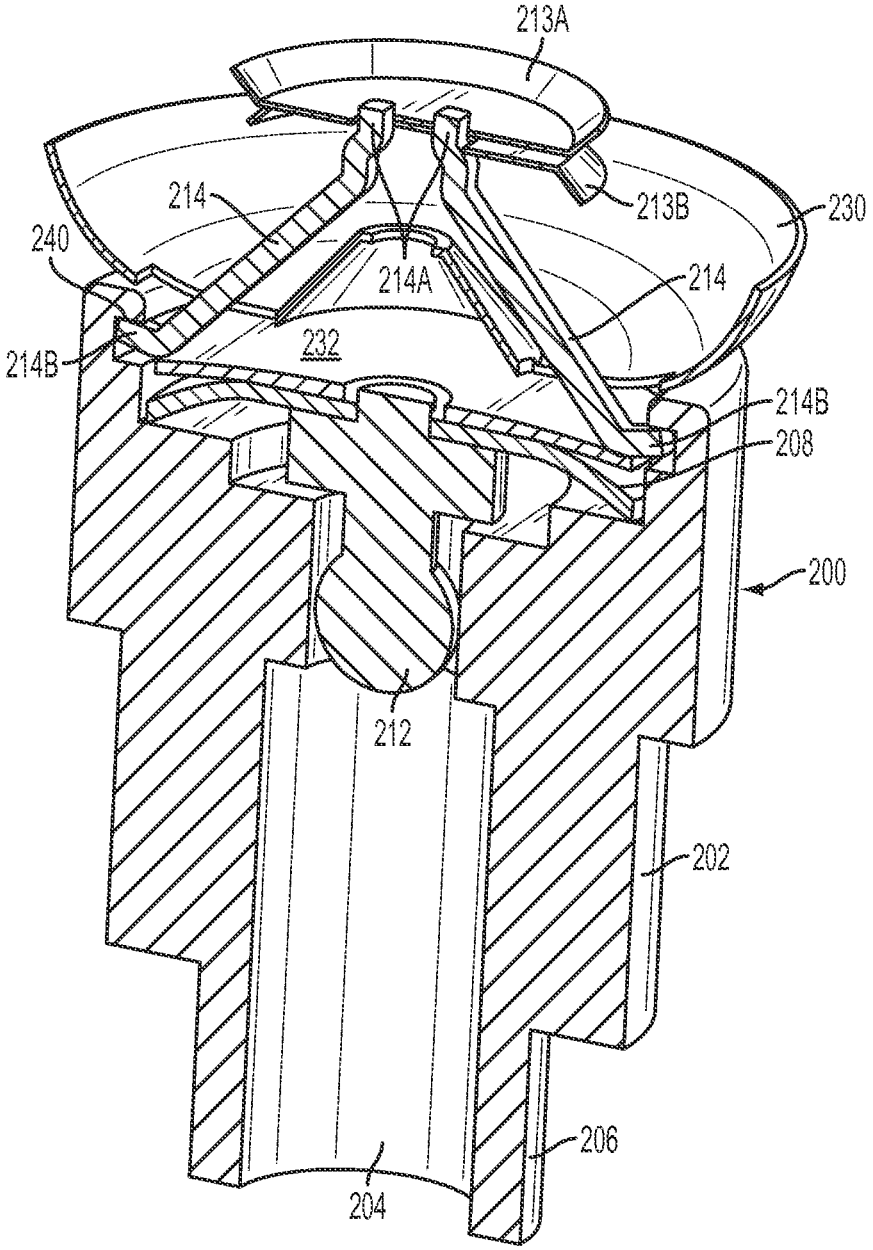
FIG. 11 is a side-perspective, cross-sectional view of the sprinkler of FIG. 7.
Figure 12:
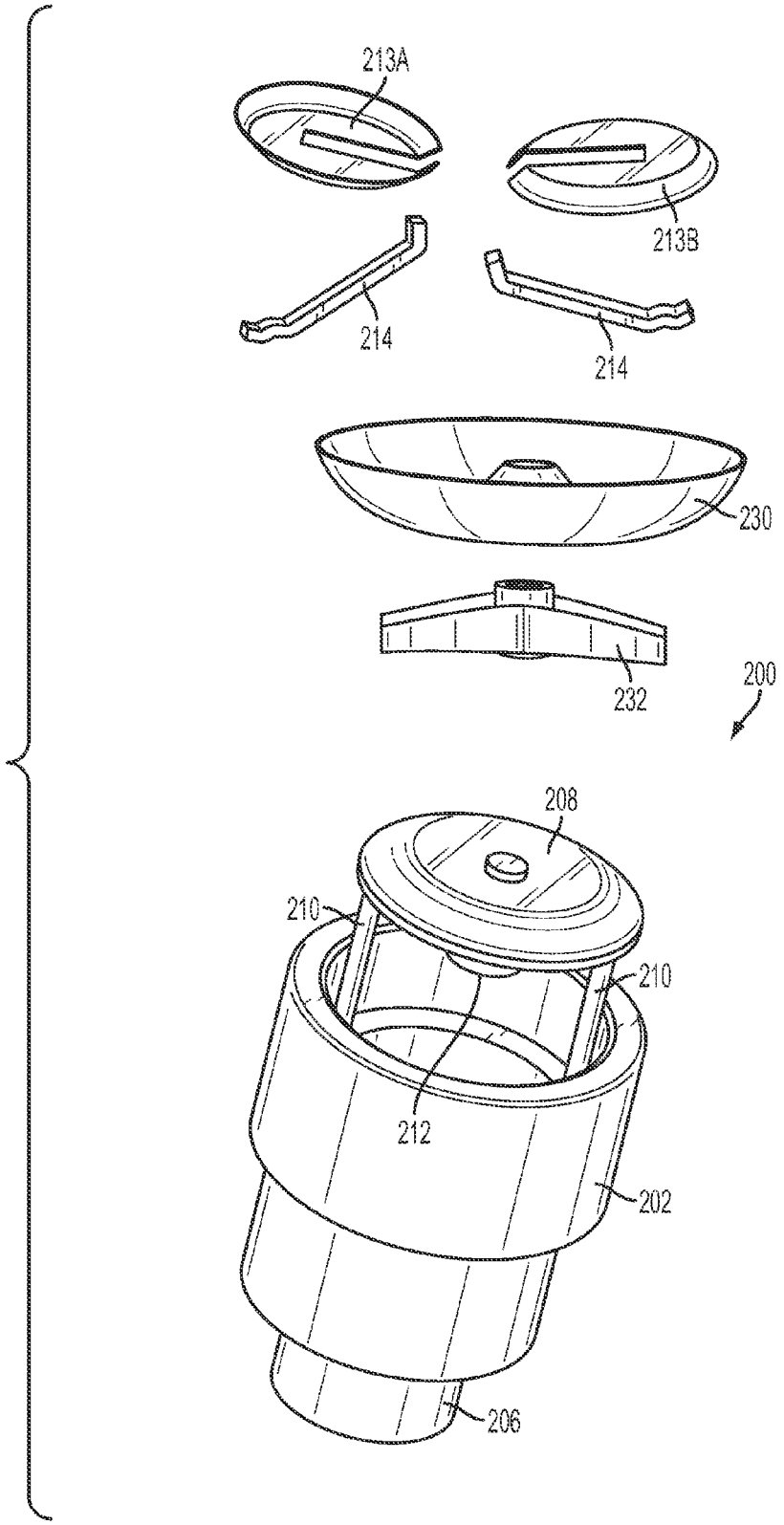
FIG. 12 is a partially-exploded, perspective view showing the sprinkler of FIG. 7 after activation.

FIGS. 7-12 depict an embodiment of a radiation-activated sprinkler 200 having one or more fusible links distributed substantially outside the sprinkler body, deflector, and linkage mechanism. FIGS. 7-11 depict the sprinkler 200 prior to activation, and FIG. 12 shows the sprinkler 200 after activation.

Referring generally to FIGS. 7-12, the sprinkler 200 can include a sprinkler body 202 defining a main orifice 204 adapted to couple to a source of pressurized liquid, e.g., similar to the embodiment discussed above in connection with FIGS. 1-6. The sprinkler body 202 can include pipe threads 206 (not illustrated) or other structures to connect the sprinkler 200 to the components of a sprinkler system, e.g., pipes. The sprinkler 200 can also include a valve 212 (see FIG. 11) that seats on the main orifice 204 to block the source of pressurized liquid.

Referring to FIGS. 11 and 12, the sprinkler 200 can also include a deflector 208 movable between a retracted position (FIG. 11) and an extended position (FIG. 12). For example, the deflector 208 may be supported on one or more arms 210 each having one end connected to the deflector, and another end retained within a groove (not shown) or other structure in the sprinkler body 202. The arms 210 can slide within the groove, thereby allowing the deflector 208 to move between the retracted and extended positions. According to embodiments, the valve 212 can be connected to the deflector 208, and the release of liquid from the main orifice 204 during sprinkler activation can cause the deflector 208 to rise upward under the force of the liquid impinging on the deflector 208. The arms 210 and groove in the body 202 can have mating structures that prevent the deflector 208 from completely disconnecting from the body 202, as will be appreciated by one of ordinary skill in the art based on this disclosure.

Figure 7:
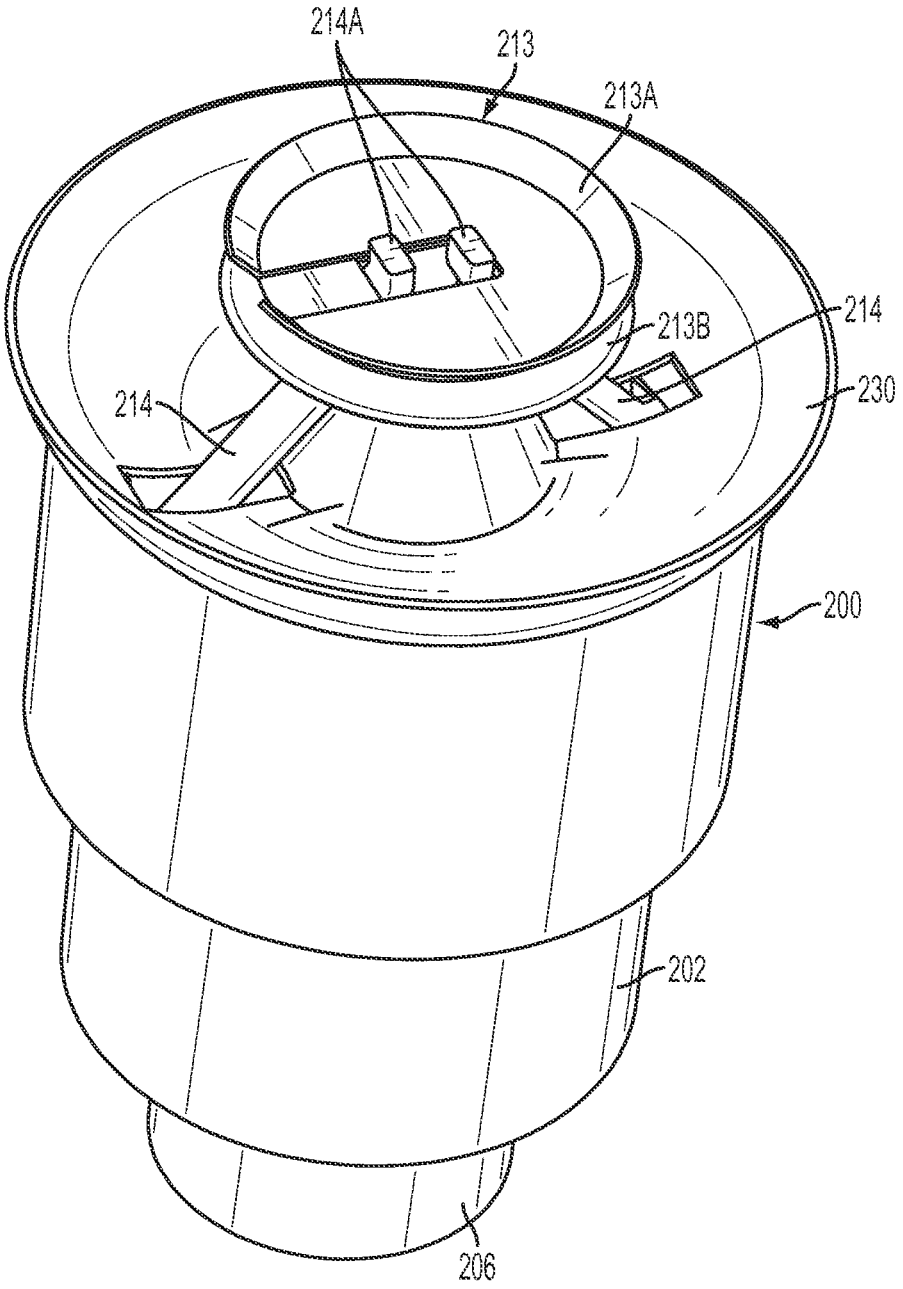
FIG. 7 is a perspective view of a radiation-activated sprinkler according to a second embodiment.
Figure 8:
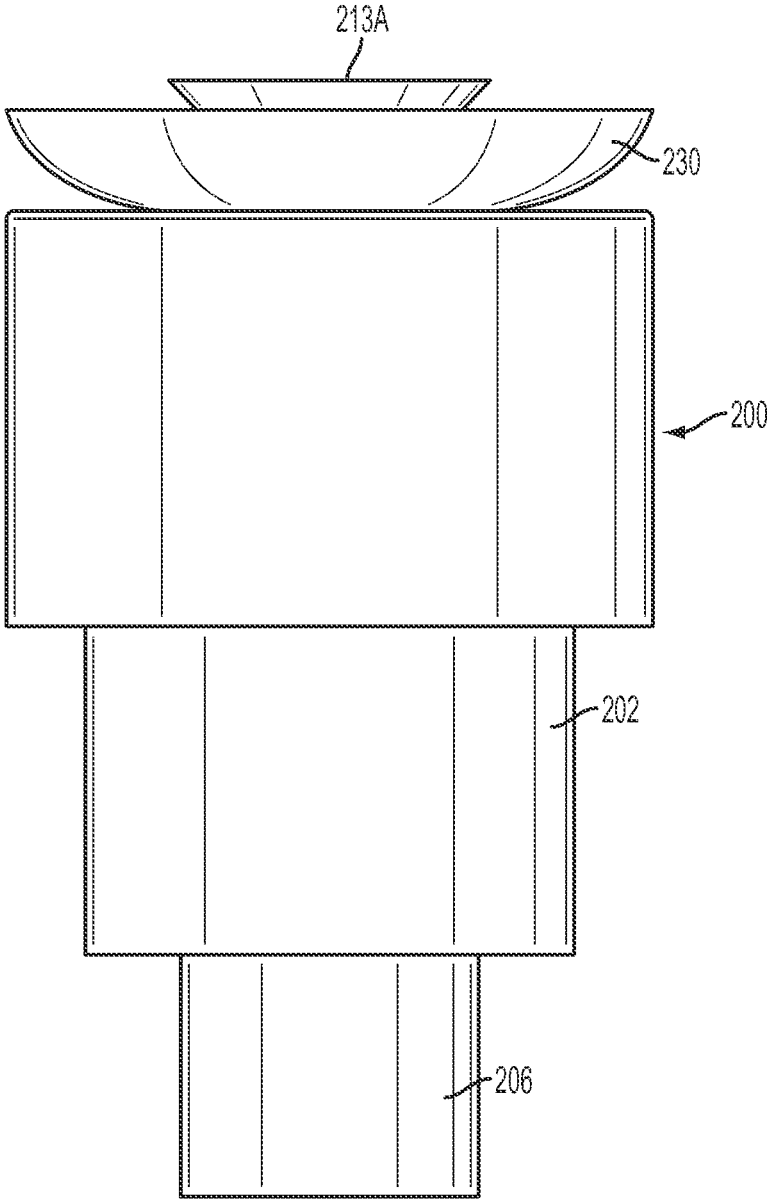
FIG. 8 is a side view of the sprinkler of FIG. 7.
Figure 9:
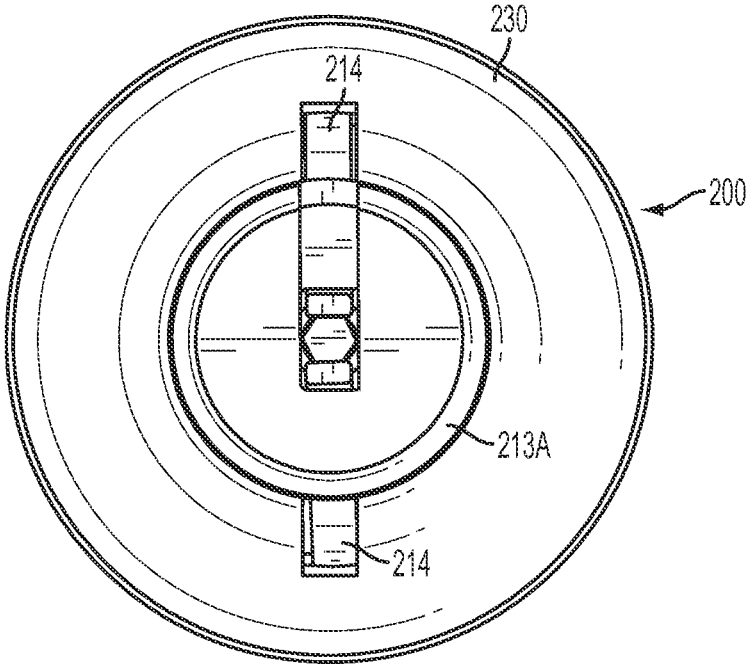
FIG. 9 is top view of the sprinkler of FIG. 7.
Figure 10:
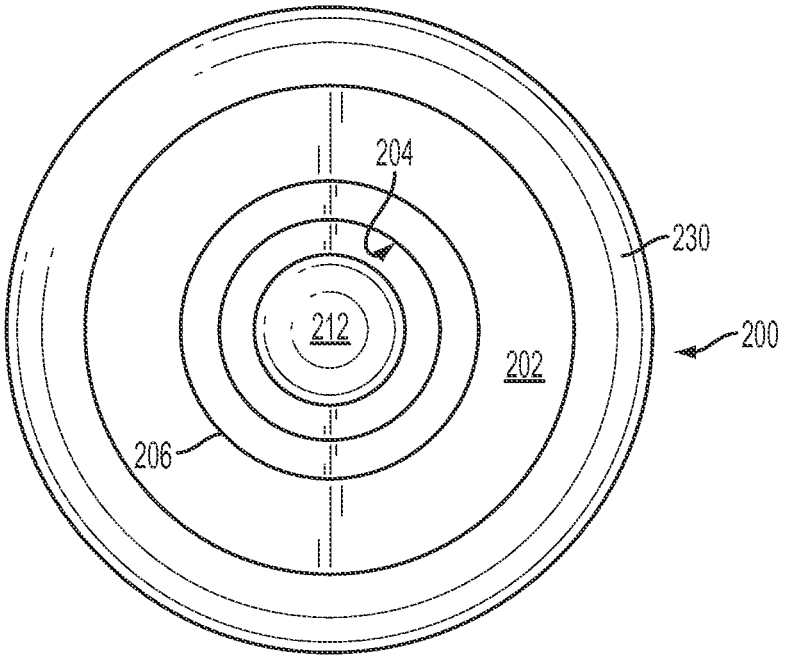
FIG. 10 is a bottom view of the sprinkler of FIG. 7.

Referring to FIGS. 7 and 11, the sprinkler can include a fusible element 213 located substantially atop the sprinkler 200. According to the embodiment shown, the fusible element 213 can comprise a first dish-shaped member 213A and a second dish-shaped member 213B substantially opposed to one another. The fusible element 213 can be coupled to the sprinkler body 202 via first and second tension arms 214, each of which may extend between the sprinkler body 202 and the shield 213.

Still referring to FIGS. 7 and 11, each of the tension arms 214 can have a first end 214A connected to the fusible element 213. For example, one of the tension arms 214 can be connected to the first dish-shaped member 213A, and the other of the tension arms 214 can be connected to the second dish-shaped member 213B, however, other configurations are possible such as the tension arms 214 being connected to both dish-shaped members 213A, 213B. Each of the tension arms 214 can have a second end 214B (see FIG. 11) that engages within an undercut 240 in the sprinkler body 202.

Referring to FIG. 11, the sprinkler 200 can include a bridge member 232 that is held in place over the valve 212 and/or deflector 208 by the second ends 214B of the tension arms 214. Accordingly, the fusible element 213, tension arms 214, sprinkler body 202, and bridge member 232 can form a rigid construct that holds the valve 212 over the main orifice 204 against the pressure of the liquid. The bridge member 232 is shown in FIG. 12 as a substantially channel-shaped member that can laterally stabilize the second ends 214B of the tension arms 214, however, other configurations are possible.

Referring to FIGS. 11 and 12, the fusible link 213 is adapted to release, e.g., melt, when exposed to an amount of radiation that exceeds a predetermined threshold. Accordingly, when the sprinkler is exposed to a sufficiently large amount of radiation, fusible element 213 will melt, causing the fusible element 213 to separate; releasing from the tension arms 214. As a result, the tension arms 214 can separate from the sprinkler body 202, and the bridge member 232 can disengage from the valve 212 and/or deflector 208. This, in turn, allows the valve 212 to release from the main orifice 204, causing water or other liquid to expel from the main orifice 204. The force created by fluid impinging on the deflector 208 can cause the deflector 208 to reach the extended position, as shown in FIG. 12, and deflect the fluid in a pattern suitable to suppress a fire. Referring to FIG. 11, the sprinkler 200 can include a reflector 230 having a convex reflective surface adapted to direct radiation onto the fusible element 213. According to embodiments, the reflector 230 can have a reflective surface facing the fusible element 213. According to embodiments, the reflector 230 can be made from any polished metal that exhibits a high level of reflectivity in the infrared spectrum, however, other embodiments are possible.

Figure 13:
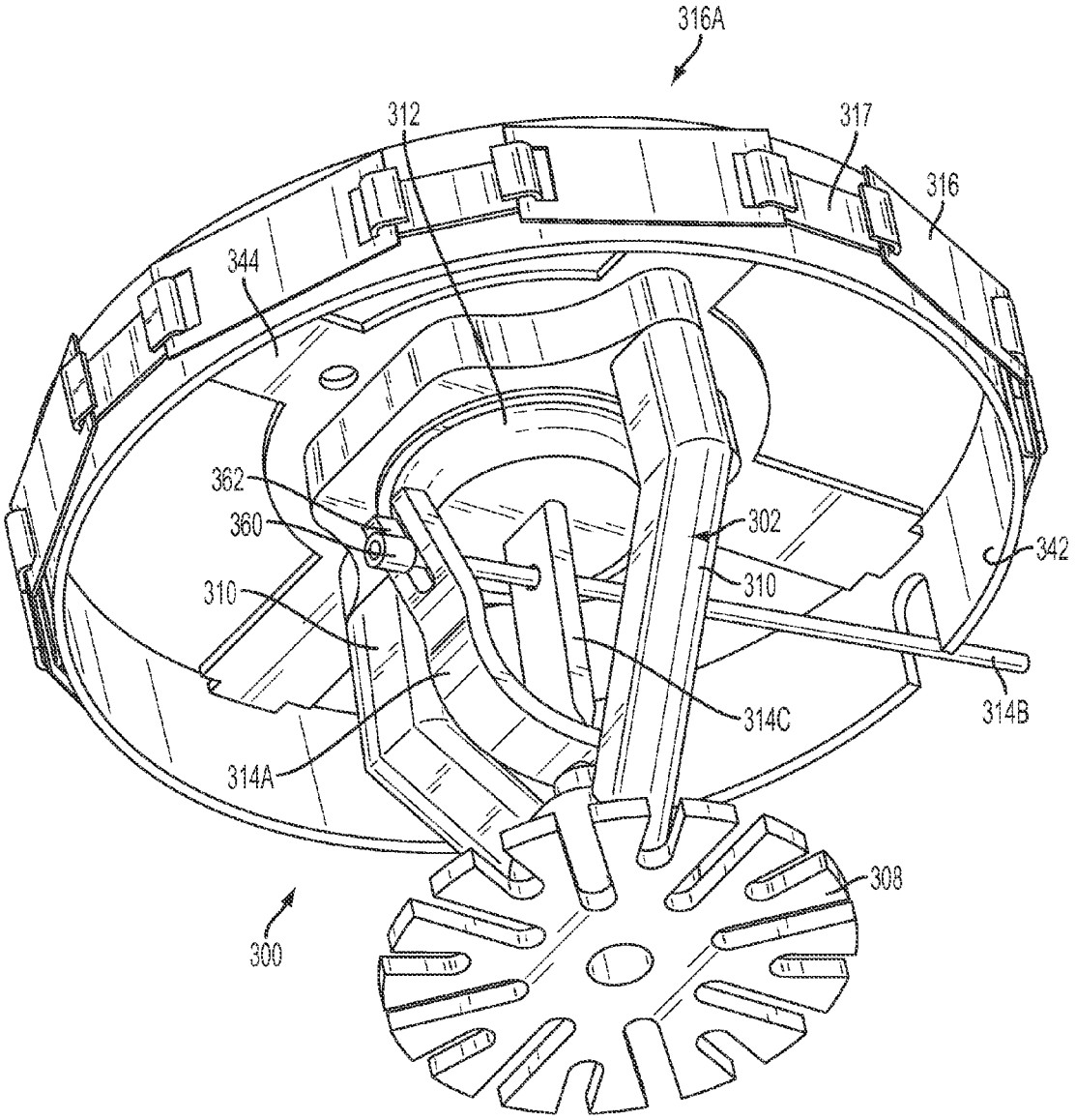
FIG. 13 is a perspective view of a radiation-activated sprinkler according to a third embodiment.
Figure 14:
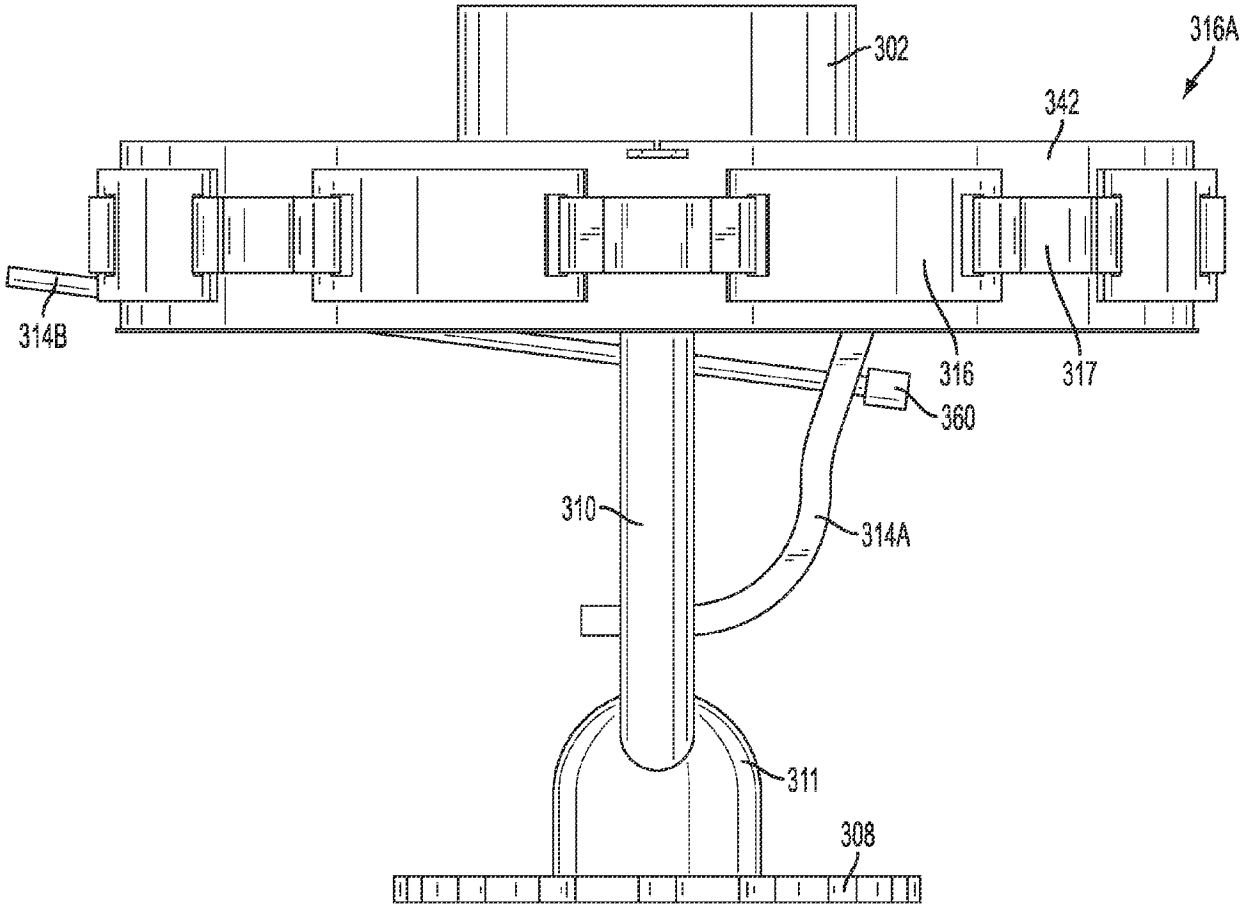
FIG. 14 is a side view of the sprinkler of FIG. 13.

FIGS. 13-17 depict another embodiment of a radiation-activated sprinkler 300 having one or more fusible links distributed circumferentially around the sprinkler body, deflector, and linkage mechanism. The sprinkler 300 can include a sprinkler body 302 defining a main orifice 304, shown in FIG. 17. The main orifice 304 can be adapted to couple to a source of pressurized liquid, e.g., similar to the embodiments discussed above in connection with FIGS. 1-12. The sprinkler body 302 can include pipe threads 306 (internal threads) or other structures to connect the sprinkler 300 to the components of a sprinkler system, e.g., pipes. The sprinkler 300 can also include a valve 312 (see FIG. 11) that seats on the main orifice 304 to block the source of pressurized liquid. As shown in FIGS. 13 and 14, the sprinkler 300 can include a deflector 308 coupled to the sprinkler body 302, e.g., through arms 310 that connect at deflector mount 311, however, other configurations are possible.

Figure 15:
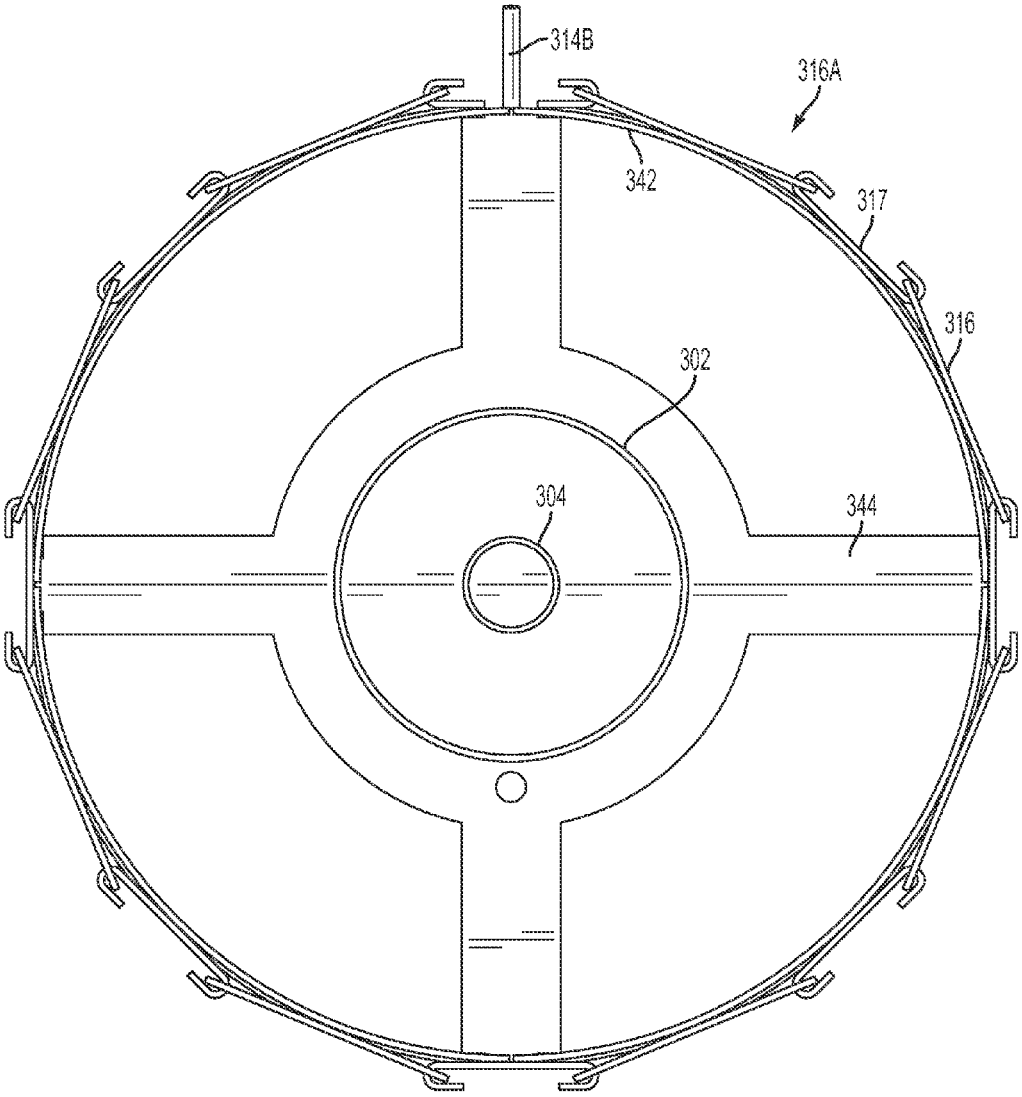
FIG. 15 is a bottom view of the sprinkler of FIG. 13.
Figure 16:
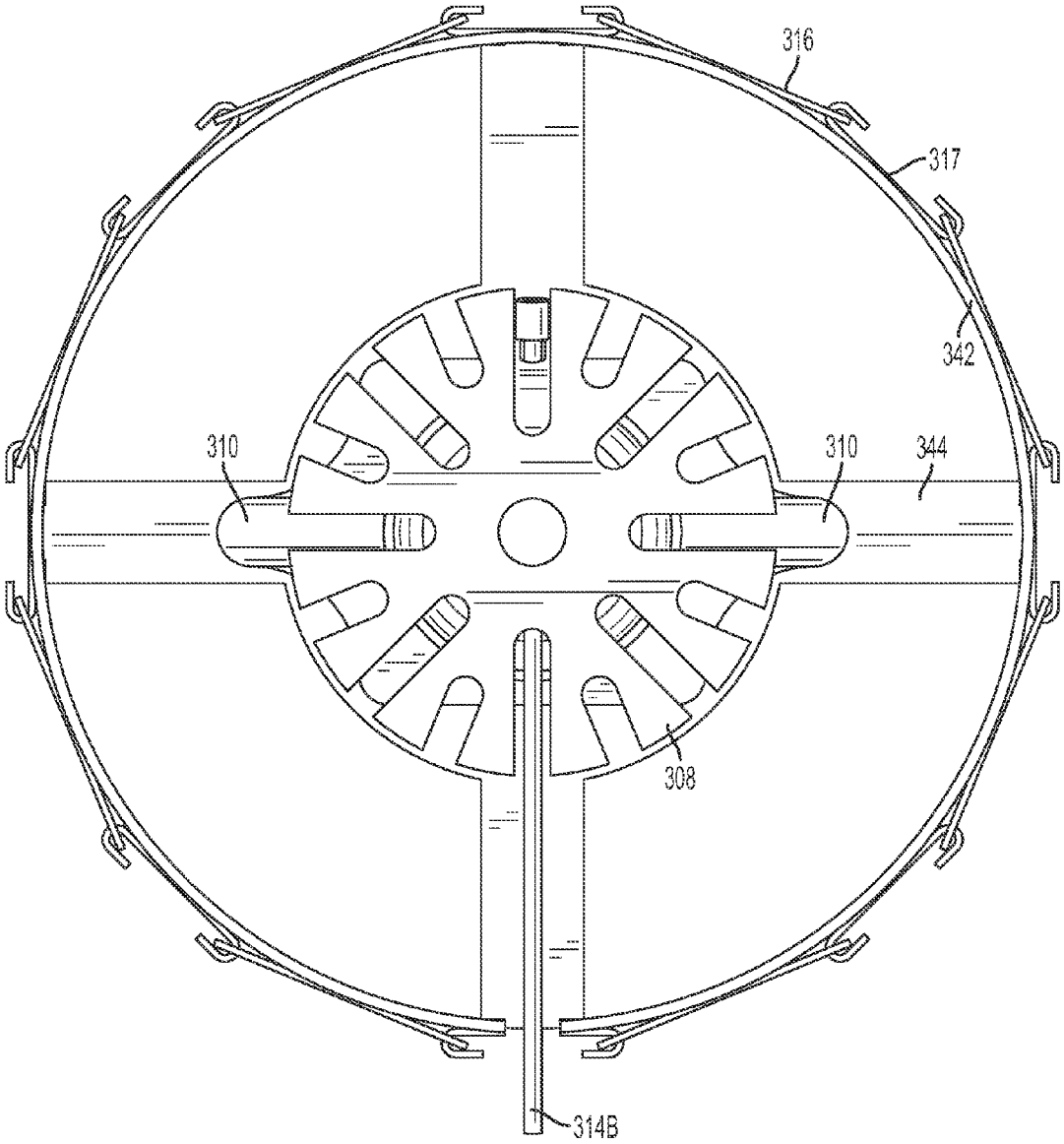
FIG. 16 is a top view of the sprinkler of FIG. 13.

As best seen in FIGS. 13-15, the sprinkler 300 can include a multiple fusible links 316 extending substantially circumferentially around the sprinkler body 302 and other sprinkler components. For example, the fusible links 316 can form a chain 316A extending circumferentially with respect to the sprinkler body 302. The chain can include multiple fusible links 316 joined with non-fusible elements 317 in any number of ways. For example, each non-fusible element 317 can have opposed bent ends that engage with recesses in the fusible links 316; however, other configurations are possible. Still referring to FIGS. 13-15, the chain 316A can be mounted under tension around a circumferential support 342 that is coupled to the sprinkler body 302, for example, by bracket 344. According to an alternative embodiment, the non-fusible elements 317 can be replaced with fusible links 316, such that all or substantially all of the links in chain 316A are fusible links.

Figure 17:
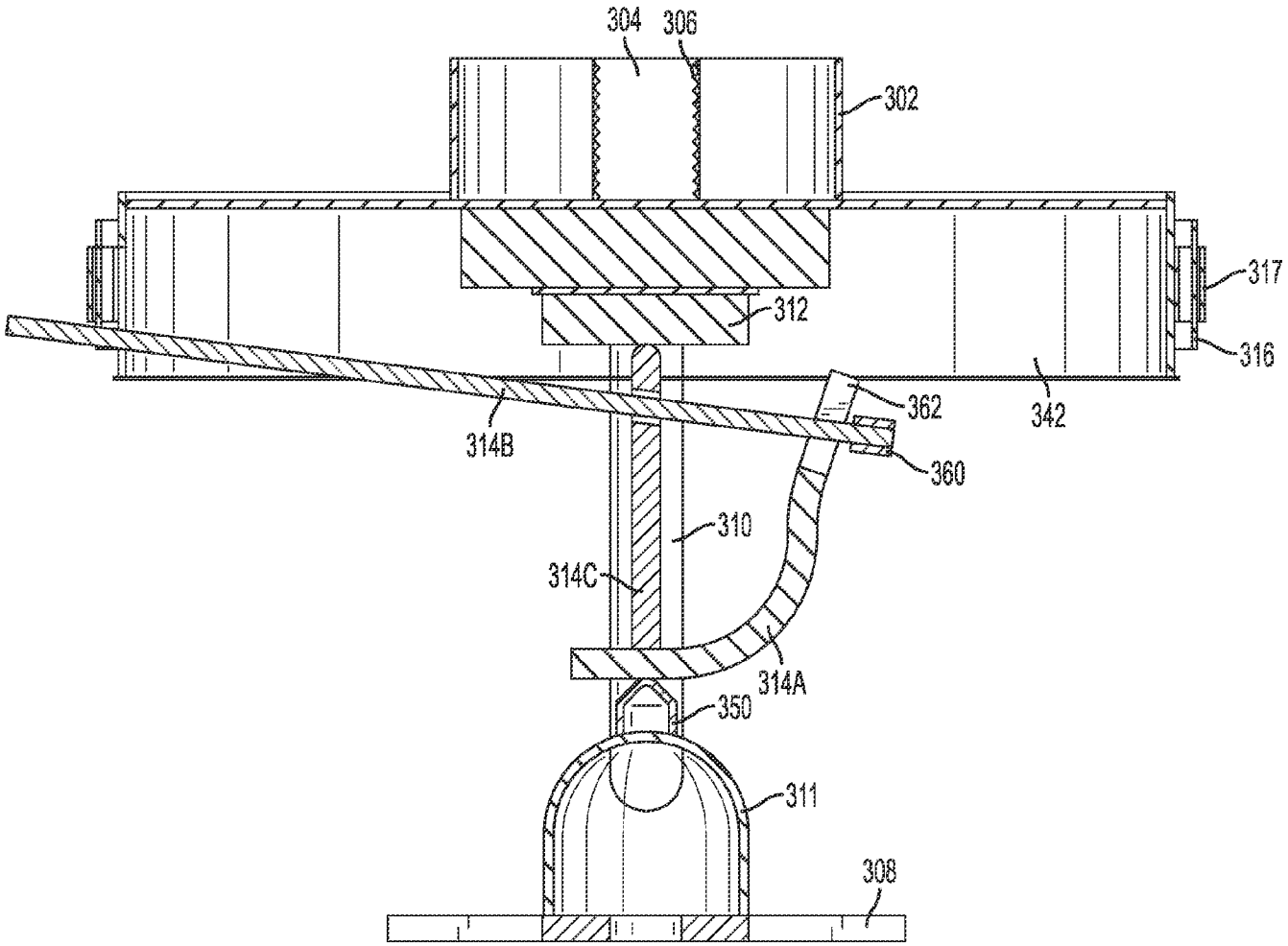
FIG. 17 is a side, cross-sectional view of the sprinkler of FIG. 13.

Referring to FIGS. 13 and 17, the sprinkler 300 can include a linkage mechanism 314A-C that couples the fusible links 316 or the chain 316A to the valve 312 in order to hold the valve 312 on the main orifice 304 prior to sprinkler activation. The linkage mechanism can include a curved tension arm 314A that cooperates with a strut 314C to hold the valve 312 in place over the main orifice 304. The linkage mechanism can also include a tension rod 314B that extends through a hole in the strut 314C. One end of the tension rod 314B can have a head 360 that engages a slot 362 in the curved tension arm 314A. The other end of the tension rod 314B can be coupled to one or more of the fusible links 316 and/or non-fusible elements 317. For example, the other end of the tension rod 314 can extend through a hole in one of the fusible links 316, and can be bonded to the hole by glue, solder, or other structure known in the art. One of ordinary skill in the art will appreciate from this disclosure, however, that other configurations can be used to join the tension rod 314B to part of the chain 316A.

With reference to FIG. 17, a set screw 350 can be located in engagement with one end of the curved tension arm 314A. As shown, the set screw 350 or another adjustable element, can extend through the deflector mount 311 to apply tension to the tension arm 314A and/or strut 314C. A substantially rigid connection can exist between the tension rod 314B and the chain 316A to stabilize the tension arm 314A. This can, in turn, hold the strut 314C in place over the valve 312 prior to sprinkler activation.

As with previous embodiments, the fusible links 316 are adapted to release, e.g., melt, when exposed to a predetermined amount of radiation. When one or more of the fusible links 316 melts, the chain 316A loses tension and releases from the support 342. This in turn destabilizes the tension rod 314B, and allows the curved tension arm 314A and strut 314C to release from the valve 312 under the force of the pressurized fluid in main orifice 304, thereby triggering sprinkler activation.

As mentioned previously, the sprinklers described above can be used in situations where radiation is the primary, or only, heat source. According to embodiments, the fusible elements (e.g., links 116, 216, 316) can be formed of solder, such as solder with a well-defined melting temperature, e.g., indalloy 158. For example, according to an embodiment, the fusible elements can comprise indalloy 158, Bi—Pb—Sn—Cd solder alloy manufactured by Indium Corporation of America, and having a melting point of 158° F. Additionally, embodiments can include one or more coatings on the fusible elements to increase their sensitivity to radiation. For example, embodiments of the links 116, 212, 316 can be coated with high emissivity paint. According to an embodiment, the paint can be a selective black, silicone-based paint which collects heat more efficiently than ordinary black paint. For example, Thurmalox® Solar Coating may be used. According to embodiments, the fusible links can be formed by solder joints (e.g., indalloy 158) located between alloy components (e.g., nickel alloy). According to embodiments employing soldered fusible elements coated with black high emissivity paint, the sprinklers can activate in response to radiation alone at intensity levels starting as low as about 2-3 $kW/m^2$.

While various embodiments of the present invention have been described above, it should be understood that they have been presented by way of example only, and not limitation. For example, the invention can be applied to the measurement of many other particulates in an air stream and is not limited to the measurement of smoke. Thus, the breadth and scope of the present invention should not be limited by any of the above-described embodiments, but should instead be defined only in accordance with the following claims and their equivalents.

What is claimed:

1. A radiation-activated sprinkler, comprising:

a sprinkler body defining a main orifice, the main orifice adapted to couple to a source of pressurized liquid;

a deflector coupled to the body;

a valve adapted to seat on the main orifice to block the source of pressurized liquid;

a linkage mechanism adapted to retain the valve on the main orifice;

one or more fusible links coupled to the linkage mechanism, wherein the one or more fusible links are located substantially externally with respect to the sprinkler body, deflector, and linkage mechanism;

high emissivity paint located on the one or more fusible links;

wherein the one or more fusible links are adapted to melt when exposed to radiation at a level of about 3 $kW/m^2$ or more, thereby releasing the linkage mechanism from the valve.

2. The radiation-activated sprinkler of claim 1, wherein the one or more fusible links are distributed circumferentially around the sprinkler body, deflector, and linkage mechanism.

3. The radiation-activated sprinkler of claim 1, wherein the one or more fusible links are located above the sprinkler body, deflector, and linkage mechanism.

4. The radiation-activated sprinkler of claim 1, further comprising an escutcheon fixed in place with respect to the body by the one or more fusible links.

5. The radiation-activated sprinkler of claim 4, wherein the escutcheon engages the linkage mechanism to retain the valve on the main orifice.

6. A radiation-activated sprinkler, comprising:

a sprinkler body defining a main orifice, the main orifice adapted to couple to a source of pressurized liquid;

a deflector coupled to the body;

a valve adapted to seat on the main orifice to block the source of pressurized liquid;

an escutcheon fixed in place with respect to the body by one or more fusible links that are adapted to melt when exposed to an amount of radiation that exceeds a predetermined threshold; and a linkage mechanism adapted to retain the valve on the main orifice, wherein the linkage mechanism comprises a strut extending between the valve and the escutcheon, the strut having a first end that directly engages the escutcheon and a second end that directly engages the valve.

7. The radiation-activated sprinkler of claim 6, further comprising one or more arms that couple the deflector to the sprinkler body, wherein the strut extends through the deflector.

8. The radiation-activated sprinkler of claim 6, wherein the escutcheon is substantially dome-shaped and defines an outer periphery.

9. The radiation-activated sprinkler of claim 8, wherein multiple fusible links are located around the outer periphery of the escutcheon.

10. The radiation-activated sprinkler of claim 9, further comprising a lower housing coupled to the sprinkler body, wherein the escutcheon is fixed in place with respect to the sprinkler body by the lower housing.

11. The radiation-activated sprinkler of claim 10, wherein multiple soldered links are located between the escutcheon and the lower housing.

12. A radiation-activated sprinkler, comprising:

a sprinkler body defining a main orifice, the main orifice adapted to couple to a source of pressurized liquid;

a deflector coupled to the sprinkler body;

a valve adapted to seat on the main orifice to block the source of pressurized liquid;

a linkage mechanism adapted to retain the valve on the main orifice, the linkage mechanism comprising a first tension arm and a second tension arm extending between the sprinkler body and a fusible element;

the fusible element comprising a first dish-shaped member and a second dish-shaped member located against one another, wherein each of the first and second tension arms has a first end connected to the fusible element by a fusible link; and a reflector located between the sprinkler body and the fusible element, wherein the reflector has a reflective surface adapted to direct radiation toward the fusible element;

wherein the fusible links are adapted to melt when exposed to an amount of radiation that exceeds a predetermined threshold, thereby releasing the linkage mechanism from the valve.

13. The radiation-activated sprinkler of claim 12, wherein each of the first and second tension arms has a second end that retains the valve within the main orifice.

14. The radiation-activated sprinkler of claim 13, wherein the sprinkler body defines an undercut, and the second ends of the first and second tension arms are engaged within the undercut.

15. The radiation-activated sprinkler of claim 14, further comprising a bridge member that engages the valve, wherein the second ends of the first and second tension arms engage the bridge member.

16. The radiation-activated sprinkler of claim 15, wherein the bridge member is substantially channel-shaped.

17. The radiation-activated sprinkler of claim 1, wherein the deflector is located in a retracted position prior to sprinkler activation, and activation of the sprinkler moves the deflector to an extended position.

18. The radiation-activated sprinkler of claim 17, wherein the valve is coupled to the deflector.

19. The radiation-activated sprinkler of claim 1, wherein the one or more fusible links comprise solder indalloy 158.

20. A method of activating a sprinkler, comprising:

providing a sprinkler including a main orifice coupled to a supply of fluid, a valve seated on the main orifice, one or more fusible links coupled to the valve, and high emissivity paint located on the one or more fusible links; and subjecting the sprinkler to radiation, wherein exposure to external radiation at a level of about 3 $kW/m^2$ or more causes one or more of the fusible links to melt, whereby the valve displaces from the main orifice and the fluid expels from the main orifice.

21. The method of claim 20, wherein the one or more fusible links melt when exposed to radiation alone.

22. The method of claim 20, wherein the sprinkler is located in a free space above a fire hazard.

23. The method of claim 22, wherein the sprinkler is located at least about five feet from a horizontal surface.

24. The sprinkler of claim 1, wherein the one or more fusible links comprises a chain of fusible links extending circumferentially around the sprinkler body, deflector, and linkage mechanism, wherein the chain of fusible links is coupled to the linkage mechanism.

* * * * *